US008643509B1

(12) United States Patent
Chen et al.

(10) Patent No.: US 8,643,509 B1
(45) Date of Patent: Feb. 4, 2014

(54) METHODS AND SYSTEMS FOR PROVIDING SLOSHING ALERTS AND ADVISORIES

(75) Inventors: Henry Chen, San Francisco, CA (US); Jonathan David Elkin, Tiburon, CA (US); Lang Deng, Castro Valley, CA (US); Willie Z. Cheng, San Francisco, CA (US); Philip J. Ballou, Alameda, CA (US); John R. Murk, El Cerrito, CA (US); Joel S. Meltzner, Littleton, CO (US)

(73) Assignee: The Boeing Company, Chicago, IL (US)

( * ) Notice: Subject to any disclaimer, the term of this patent is extended or adjusted under 35 U.S.C. 154(b) by 257 days.

(21) Appl. No.: 13/017,192

(22) Filed: Jan. 31, 2011

(51) Int. Cl.

| | |
|---|---|
| ***G08B 23/00*** | (2006.01) |
| ***B63B 25/08*** | (2006.01) |
| ***B63B 25/24*** | (2006.01) |
| ***B63B 39/14*** | (2006.01) |
| ***B63B 43/04*** | (2006.01) |

(52) U.S. Cl.
USPC ..... 340/984; 114/74 R; 340/440

(58) Field of Classification Search
USPC ..... 62/241; 114/74 A, 74 R, 74 T, 125, 256, 114/122; 220/560.11, 562–564, 734; 340/429, 440, 450, 463, 984
See application file for complete search history.

(56) References Cited

U.S. PATENT DOCUMENTS

| | | | | |
|---|---|---|---|---|
| 2,997,973 | A * | 8/1961 | Hawthorne et al. | 114/74 T |
| 3,938,258 | A * | 2/1976 | Zook | 33/366.12 |
| 4,647,928 | A * | 3/1987 | Casey et al. | 340/984 |
| 4,651,128 | A * | 3/1987 | Kolb | 340/440 |
| 5,383,359 | A * | 1/1995 | Challoner et al. | 73/290 R |
| 5,560,161 | A * | 10/1996 | Lou | 52/167.2 |
| 6,023,221 | A * | 2/2000 | Michelotti | 340/471 |
| 6,694,225 | B2 * | 2/2004 | Aga et al. | 701/1 |
| 7,546,224 | B2 * | 6/2009 | Campbell | 703/1 |
| 7,714,712 | B2 * | 5/2010 | Emigh et al. | 340/539.13 |
| 8,079,321 | B2 * | 12/2011 | Balasubramanian | 114/74 R |
| 2008/0217874 | A1 * | 9/2008 | Miskin | 280/6.151 |
| 2010/0256882 | A1 * | 10/2010 | Dreier et al. | 701/62 |
| 2011/0307128 | A1 * | 12/2011 | Igarashi et al. | 701/21 |

FOREIGN PATENT DOCUMENTS

| | | | | |
|---|---|---|---|---|
| JP | 07002169 | A * | 1/1995 | B63B 39/00 |

OTHER PUBLICATIONS

Rathje et al.; "Concept and Implementation of an Innovative Shipboard Routing Assistance System"; presented at Royal Institution of Naval Architects (RINA) International Conference Design and Operation of Container Ships; Apr. 23-24, 2003).*

(Continued)

*Primary Examiner* — Steven Lim
*Assistant Examiner* — Stephen Burgdorf
(74) *Attorney, Agent, or Firm* — Armstrong Teasdale LLP

(57) ABSTRACT

A method is described for providing an alert when the motion of a ship indicates a potential of sloshing damage from liquid cargo being transported by the ship. The method includes calculating, with a processing device, a natural period for the tanks holding the liquid cargo based on the configuration and fill levels of the tanks, receiving, at the processing device, data describing the actual or predicted motion of the ship with respect to three orthogonal axes, determining, with the processing device, a proximity of the natural period of the tanks to a period defined by the actual or predicted motion of the ship, and providing an alert to a user if the proximity in periods is within a threshold value.

22 Claims, 11 Drawing Sheets

(56) References Cited

OTHER PUBLICATIONS

Mikelis et al.; "Experimental and Numerical Simulation of Sloshing Behaviour in Liquid Cargo Tanks and its Effect on Ship Motions"; National Conference on Numerical Methods for Transient and Coupled Problems, Jul. 9-13, 1984 Venice, Italy, Report 0661-P, 1984, Delft University of Technology.*

Hine, L.; New Software Aims to Reduce Risk of Sloshing; TradeWinds; Dec. 10, 2010; vol. 21, No. 49; 2 pages.

* cited by examiner

METHODS AND SYSTEMS FOR PROVIDING SLOSHING ALERTS AND ADVISORIES

BACKGROUND

The field of the disclosure relates generally to the effects of sloshing within a tank of fluid on a ship, and more particularly, to methods and systems for providing sloshing alerts and advisories.

Sloshing describes the phenomenon of a liquid inside a tank where the liquid is excited by the motion of the vehicle carrying the tank. For example, on large liquid natural gas (LNG) carriers, sloshing of the LNG due to ship motion in a seaway can lead to extremely high loads on the cargo tank walls, resulting in extensive damage to the tank structure or insulation material. The cargo tank is particularly susceptible to damage when it is partially filled, and further susceptible to damage when the natural period of the liquid in the tank is in resonance with (near or equal to) roll or pitch motion periods of the ship.

Sloshing is stochastic, meaning that impacts cannot be predicted with certainty and the magnitudes of such impacts can vary widely. There are several factors influencing the severity of a sloshing response, including tank design configuration and local details such as chamfered topsides fabricated within the individual tanks, the fill level of the tanks, as well as excitation motion characteristics, including period, magnitude and duration. Factors influencing vessel motion include the loading condition of the vessel (i.e. the metacentric height (GM) and draft of the ship), inertia properties of the vessel about its axis of rotation, free surface effects (i.e. partially filled tanks effectively reduce GM), damping from ship appendages, as well as ship speed and heading relative to incoming waves.

As mentioned above, some LNG tanks are configured with a chamfered topside and hopper bottoms to reduce the chance of resonance while the tank is more than 95% full during a loaded passage, or less than 5% fill during the ballast leg. Loading and unloading operations usually take place at terminals or docks in protected water with good weather. As the LNG sector expands, larger tank sizes in larger vessels are built with new trades, which may entail the vessel operating with partially filled tanks and conducting cargo operations in more exposed waters. The increases in size and the need for partial fill loads also result in changes to tank natural periods. Certain of these periods are in range with roll and pitch periods of such ships. Coupled with increased severity of sea states on some trade routes, the risk of cargo and ship damage has significantly increased, especially when liquid sloshing occurs due to resonance with ship motions.

As an example, damage has occurred to several membrane tank LNG carriers due to sloshing of the LNG cargo. Lower filling levels in these LNG carriers can actually produce higher sloshing loads. Further, the study of sloshing is complex as many aspects are not easily addressed by calculations and testing. Computational fluid dynamic determinations are not fully reliable as they do not consider entrapped bubbles. As a result of recent sloshing damage incidents, regulations directed to lower filling heights for membrane ships have been reduced twice over a relatively short period. However, these reductions in cargo greatly restrict the flexibility LNG transporters have in dispensing partial loads at multiple sites. As a result, LNG transporters are currently restricted to travelling only with practically full or practically empty loads.

BRIEF DESCRIPTION

In one aspect, a method for providing an alert when the motion of a ship indicates a potential of sloshing damage from liquid cargo being transported by the ship is provided. The method includes calculating, with a processing device, a natural period for the tanks holding the liquid cargo based on received user inputs relating to a configuration of the tanks and a fill percentage of the tanks, receiving, at the processing device, data describing the actual motion of the ship with respect to three orthogonal axes, determining, with the processing device, a proximity of the natural period of the tanks to a period defined by the actual motion of the ship, and providing an alert to a user if the proximity in periods is within a threshold value.

In another aspect, a sloshing alert and advisory system for a ship operable to transport a liquid cargo is provided. The system includes a processing device, a user interface communicatively coupled to the processing device, a memory communicatively coupled to the processing device, the memory including data defining a natural period of liquid cargo within the ship, and a ship motion sensor communicatively coupled to the processing device and operable to provide data describing the motion of the ship with respect to three orthogonal axes. The processing device is programmed to provide an alert via the user interface when actual ship motions are approaching conditions that can lead to excessive sloshing of the liquid cargo, based on the natural period of the liquid cargo.

In still another aspect, a non-transitory computer-readable medium for providing an alert when the motion of a ship indicates a potential of sloshing damage from liquid cargo being transported by the ship is provided. The non-transitory computer-readable medium includes computer-executable instructions embodied thereon, wherein when executed by at least one processor, the computer-executable instructions cause the at least one processor to 1) determine, based on data related to the configuration of the tanks containing the liquid cargo and a fill percentage for each of the tanks, a natural period of the liquid cargo within the tanks, 2) determine an actual motion of the ship with respect to three orthogonal axes based on data received from a ship motion sensor, and 3) provide an alert via a user interface communicatively coupled to at least one processor when actual ship motions are approaching conditions that can lead to excessive sloshing of the liquid cargo, based on the determined natural period of the liquid cargo.

The features, functions, and advantages that have been discussed can be achieved independently in various embodiments or may be combined in yet other embodiments, further details of which can be seen with reference to the following description and drawings.

DETAILED DESCRIPTION

The description of different advantageous embodiments is presented herein for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

Figure 1:
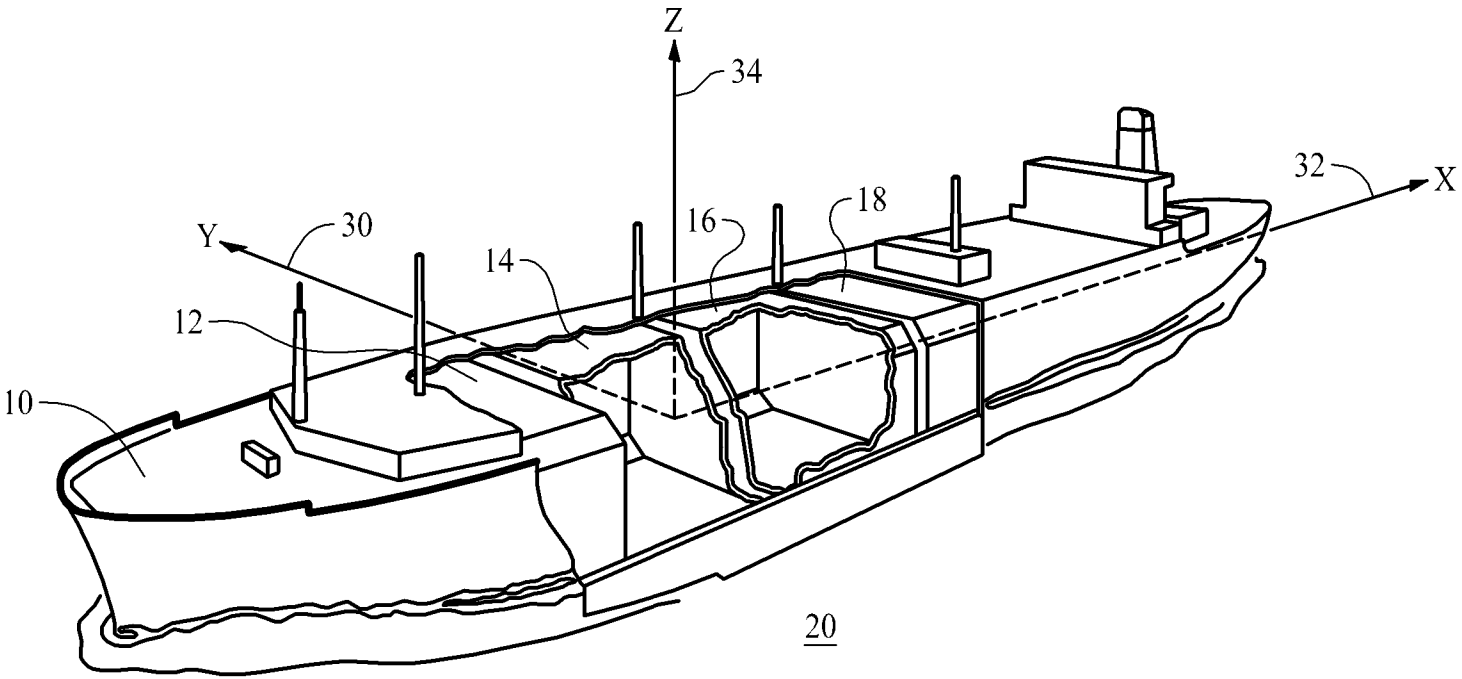
FIG. 1 is a depiction of a liquid natural gas transport ship.

FIG. 1 is a depiction of a ship 10. More specifically, ship 10 is a liquid natural gas (LNG) transport ship. Ship 10 includes multiple tanks 12, 14, 16, and 18. Ships that include other tanks configurations are also known. As is easily understood, the transport of any liquid in a shipboard tank includes a degree of difficulty as the motion of waves within the body of water 20 is eventually transferred to the liquid being transported, and is referred to herein as sloshing.

Liquid sloshing is a phenomenon in a LNG tank caused by the motion of the ship 10 in a seaway. When the ship encounters sea states with sufficient wave energy, the liquid is excited by ship motions. Even with relatively moderate ship motions, the transfer of energy may lead to liquid motions inside the tank, especially when the period of ship motion is close to the natural period of the liquid within the tanks. The resulting wave action of liquids within these tanks can cause severe damage to the cargo containment system if the wave actions (the sloshing) are left unchecked.

Figure 2:
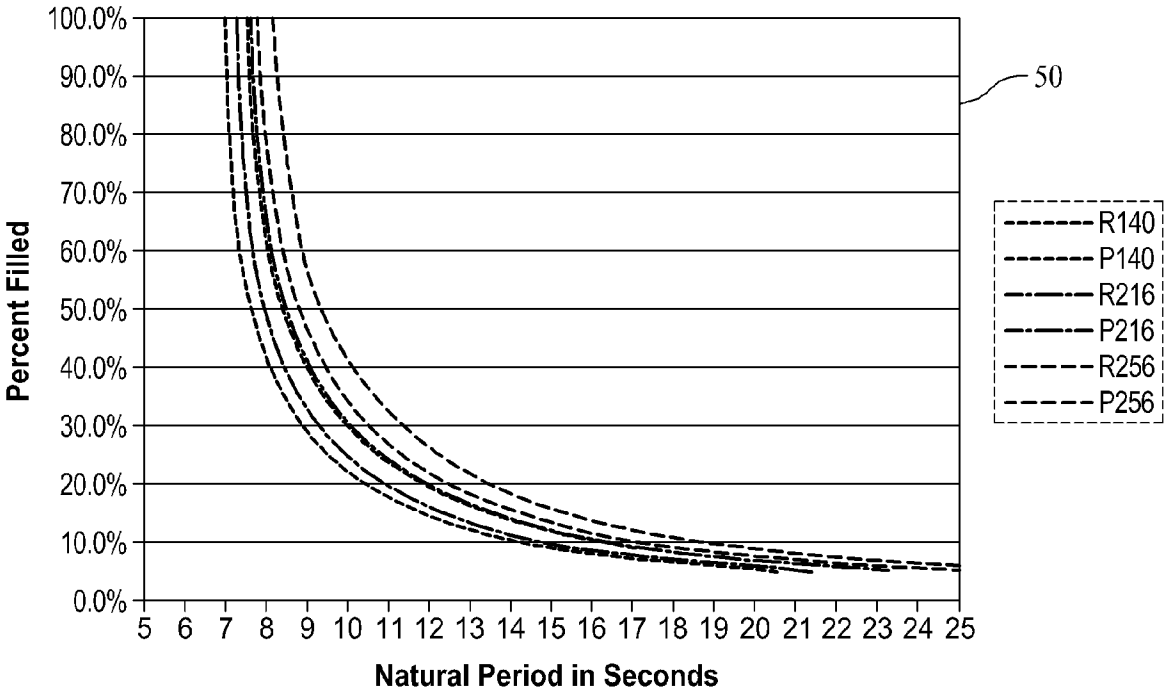
FIG. 2 is a graph that illustrates the natural period for liquid in a tank against an indication of an amount of liquid, by percent, in the tank.

More specifically and again referring to FIG. 1, due to the forces exerted onto the hull of the ship by the water conditions (e.g., height and frequency of waves impacting the hull) ship 10 has a continuous motion about pitch 30, roll 32, and yaw 34 axes. The degree of sloshing is in part affected by the amount of liquid in the tanks 12, 14, 16, and 18. Simply, the fuller the tank, the less room for the liquid to move about within the tank. Such conditions result in a natural period for the liquid that is reduced over the natural period for a less full tank and generally not near the period of ship motion. For a nearly empty tank, the natural period of the liquid is generally longer than the period of ship motion. However, for partially-filled tank, the sloshing period will likely be near the period of ship motion. FIG. 2 is a graph 50 that illustrates the natural period for liquid in a tank against a percentage indicative of how full the tank is.

Figure 3:
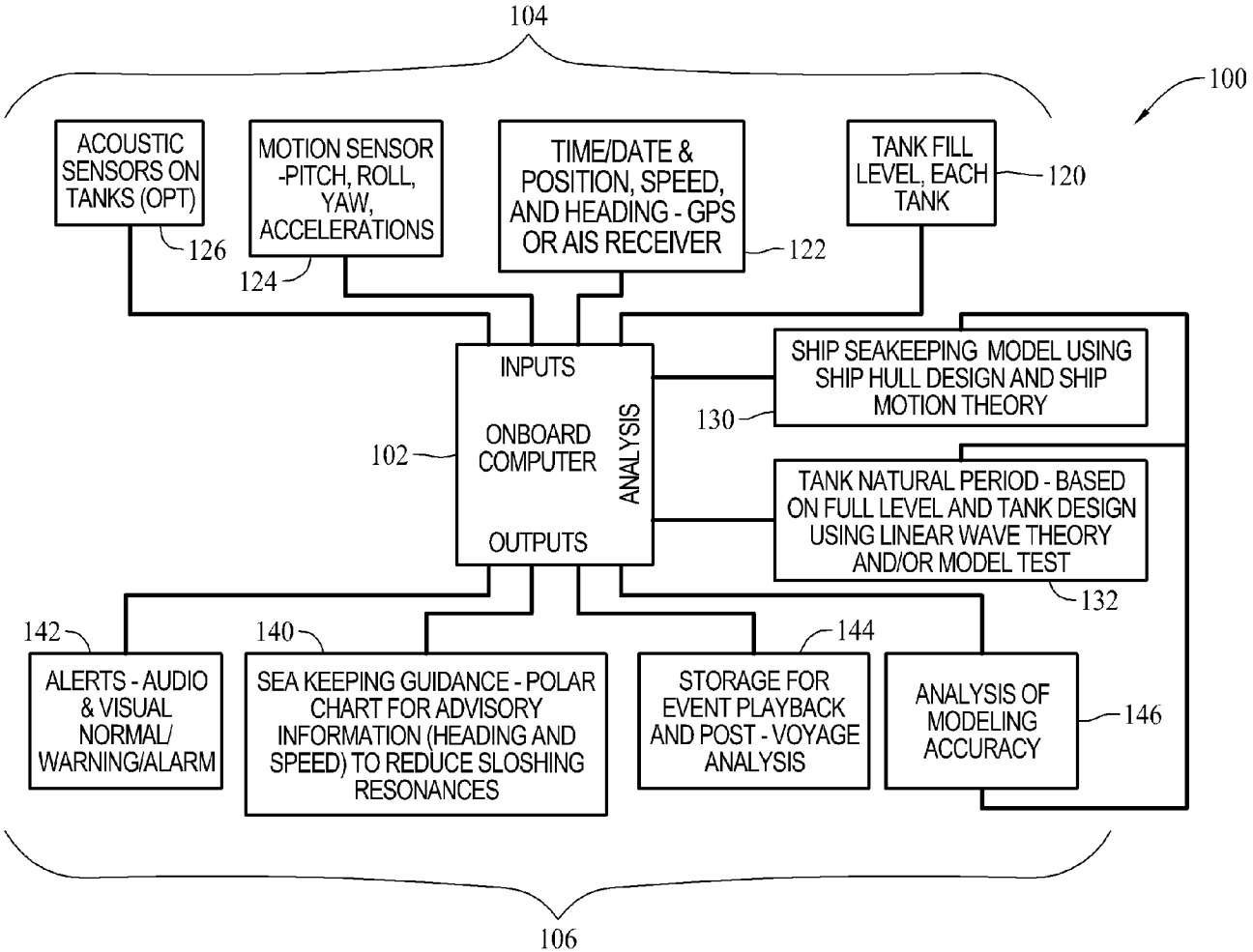
FIG. 3 is a functional block diagram of a sloshing alert and advisory system (SAAS).

Given the background provided by FIGS. 1 and 2, the described embodiments are directed to a sloshing alert and advisory system (SAAS) 100 for liquefied natural gas (LNG) ships and offshore floating units. A functional block diagram of SAAS 100 is shown in FIG. 3. The SAAS 100 provides an alert when the motion of a ship indicates a potential risk of sloshing damage to tanks from the liquid being transported. The damage can include membrane leaks and structural cracks within the tanks. In at least one embodiment, SAAS 100 also provides decision support information, for example, via a display to the ship operator on how to reduce or avoid risk of sloshing damage to tanks from the liquid being transported. Such damage avoidance measures include one or more of a change in heading, speed, route, draft and trim, and travel schedule for the ship.

More particularly and as further described below, SAAS 100 incorporates predictive and real-time motion analysis onboard the ship that can be used by the ship operator to reduce ship motions that may lead to sloshing damage. In embodiments, the ship instrumentation may include real-time motion sensors, accelerometers, and data recorders so that SAAS motion and sloshing modeling algorithms running within SAAS 100 can be improved and modified over time to match actual ship behavior. Additionally, alerts can be provided both in planning and execution phases in real-time, for example, when actual ship motions are approaching conditions that can lead to sloshing damage. Specifically, SAAS 100 provides users with advisories on how to change the conditions, including, but not limited to, ship heading, speed, route, draft and trim, and schedule so that sloshing is minimized. Further, SAAS 100 provides users anticipated results that would result from such changes.

Referring specifically to FIG. 3, SAAS 100 incorporates a computer 102 which receives a plurality of inputs 104 from shipboard systems external to SAAS 100. The computer 102 uses the data received as well as programs stored and running therein to generate a plurality of outputs 106. Particularly, computer 102 receives a tank fill level 120 from each of the tanks on the ship. Computer 102 further receives time, location, and heading data from one or more of a gyrocompass, GPS satellite compass and an automatic identification system (AIS) receiver, or from other shipboard instrumentation via a direct connection or the ship's network. Heading information is provided within the AIS signal. Such heading signals originate with a gyrocompass, GPS satellite compass, or similar device used to determine the ship heading.

Specifically, computer 102 receives and/or generates a time and date, position, speed, and heading using the data received from such systems 122. Computer 102 further receives data from motion sensors 124 on the ship. Specifically, pitch, roll, yaw, and acceleration data may be received by the computer 102. Optionally, computer 102 may also receive vibration, and/or fluid level data from one or more sensors 126 within or external to the tanks.

Computer 102 is programmed with a sea keeping model 130 for the ship that includes data relating to the design of the hull of the ship and data relating to ship motion theory for the specific ship. Further, computer 102 is programmed with tank related data 132 for each tank on the ship. Particularly, computer 102 is programmed with the natural period for each tank, based on the fill level and tank configuration, for example using one or both of linear wave theory and model test data.

Computer 102 provides certain outputs 106 including sea keeping guidance 140, alerts 142, event storage 144, and an analysis of modeling accuracy 146. In one embodiment, which is further described below, sea keeping guidance 140 takes the form of a polar chart display providing advisory information to a crew, including at least one of a suggested heading, speed, route, draft and trim, and schedule, which, according to sea conditions (as determined through weather and ocean forecasts, observations input by the user, environmental sensor data, sensor data, climatological averages, or other means), should result in reduced sloshing resonances. Alerts 142 include audio and/or visual warnings and any other alarms necessary to alert a ship's crew as to a current sloshing condition. While event storage 144 is classified as one of the outputs 106, it generally refers to a memory associated with computer 102 that provides storage of certain recorded events, for one or more of event playback and post-voyage analysis. Computer 102 also provides an analysis 146 of the modeling accuracy.

In summary, SAAS 100 advises the ship operator on headings, speeds, and other factors to minimize potential sloshing risks while underway. The advisories are based in part on forecasted weather, ocean conditions, and predicted ship motions resulting therefrom. The program running within computer 102 takes into consideration various inputs, including ship speed, heading, tank design, and the vessel's response amplitude operators for a range of fill heights, loading conditions, and more. Motion sensing hardware and software is used to acquire data that indicate situations conducive to excessive sloshing, which include calculation and prediction of resonant motions.

In one embodiment, a real-time ship motion measurement algorithm is utilized to indicate if a safe operating limit has been exceeded, in which case an alert will be issued. The algorithm includes predictive and real-time motion analysis onboard the ship that can be used by the ship operator to reduce motions that may lead to sloshing damage. To that end, SAAS 100 also provides advisories on how to change the conditions, such as heading, speed, route, etc., so that sloshing may be minimized.

As described above, the ship is instrumented with real-time sensors for motion, vibrations, and/or fluid level, and data recorders such that SAAS motion modeling can be improved and modified over time to match actual ship behavior, and so that alerts can be given both in planning and execution phases in real-time, for example, when actual ship motions are approaching conditions that can lead to sloshing damage.

Figure 4:
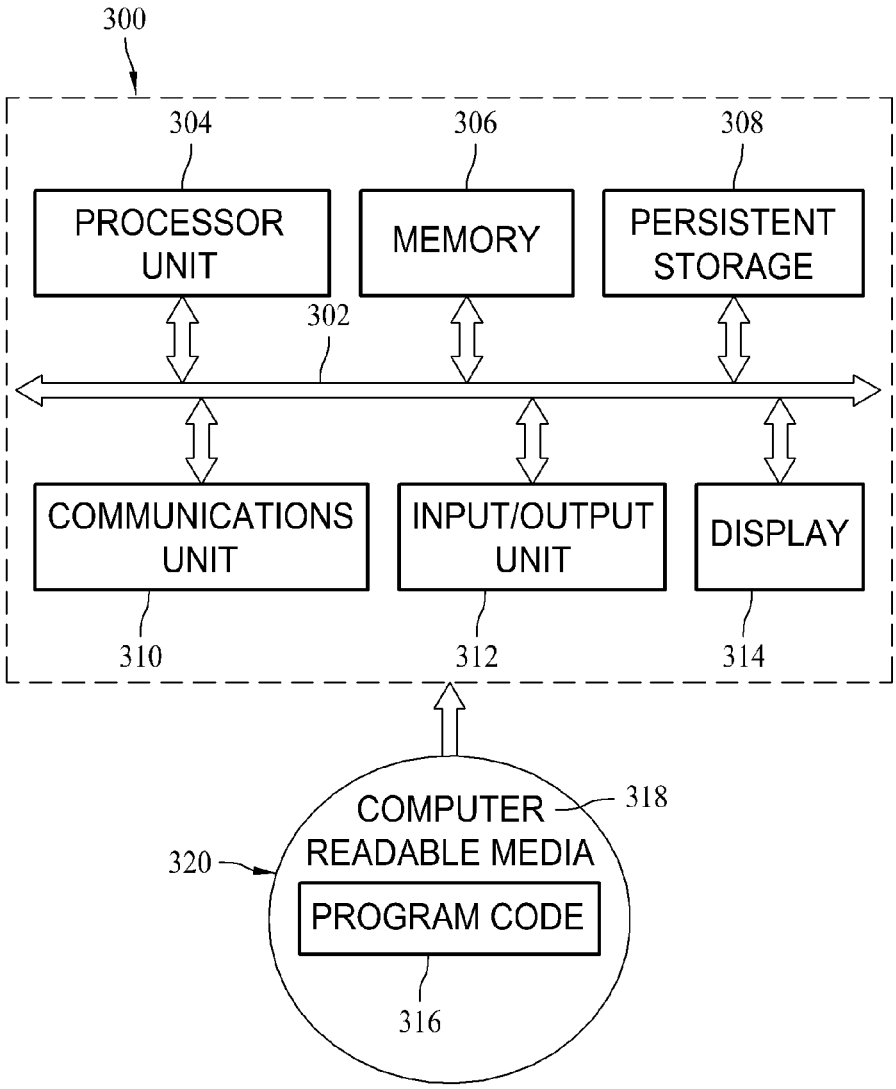
FIG. 4 is a diagram of a data processing system.

Turning now to FIG. 4, a diagram of a data processing system 300 that might be incorporated within computer 102 is depicted in accordance with an illustrative embodiment. In this illustrative example, data processing system 300 includes communications fabric 302, which provides communications between processor unit 304, memory 306, persistent storage 308, communications unit 310, input/output (I/O) unit 312, and display 314.

Processor unit 304 serves to execute instructions for software that may be loaded into memory 306. Processor unit 304 may be a set of one or more processors or may be a multiprocessor core, depending on the particular implementation. Further, processor unit 304 may be implemented using one or more heterogeneous processor systems in which a main processor is present with secondary processors on a single chip. As another illustrative example, processor unit 304 may be a symmetric multi-processor system containing multiple processors of the same type.

Memory 306 and persistent storage 308 are examples of storage devices. A storage device is any piece of hardware that is capable of storing information either on a temporary basis and/or a permanent basis. Memory 306, in these examples, may be, for example, without limitation, a random access memory or any other suitable volatile or non-volatile storage device. Persistent storage 308 may take various forms depending on the particular implementation. For example, without limitation, persistent storage 308 may contain one or more components or devices. For example, persistent storage 308 may be a hard drive, a flash memory, a rewritable optical disk, a rewritable magnetic tape, or some combination of the above. The media used by persistent storage 308 also may be removable. For example, without limitation, a removable hard drive may be used for persistent storage 308.

Communications unit 310, in these examples, provides for communications with other data processing systems or devices. In these examples, communications unit 310 is a network interface card. Communications unit 310 may provide communications through the use of either or both physical and wireless communication links.

Input/output unit 312 allows for input and output of data with other devices that may be connected to data processing system 300. For example, without limitation, input/output unit 312 may provide a connection for user input through a keyboard and mouse. Further, input/output unit 312 may send output to a printer. Display 314 provides a mechanism to display information to a user.

Instructions for the operating system and applications or programs are located on persistent storage 308. These instructions may be loaded into memory 306 for execution by processor unit 304. The processes of the different embodiments may be performed by processor unit 304 using computer implemented instructions, which may be located in a memory, such as memory 306. These instructions are referred to as program code, computer usable program code, or computer readable program code that may be read and executed by a processor in processor unit 304. The program code in the different embodiments may be embodied on different physical or tangible computer readable media, such as memory 306 or persistent storage 308.

Program code 316 is located in a functional form on computer readable media 318 that is selectively removable and may be loaded onto or transferred to data processing system 300 for execution by processor unit 304. Program code 316 and computer readable media 318 form computer program product 320 in these examples. In one example, computer readable media 318 may be in a tangible form, such as, for example, an optical or magnetic disc that is inserted or placed into a drive or other device that is part of persistent storage 308 for transfer onto a storage device, such as a hard drive that is part of persistent storage 308. In a tangible form, computer readable media 318 also may take the form of a persistent storage, such as a hard drive, a thumb drive, or a flash memory that is connected to data processing system 300. The tangible form of computer readable media 318 is also referred to as computer recordable storage media. In some instances, computer readable media 318 may not be removable.

Alternatively, program code 316 may be transferred to data processing system 300 from computer readable media 318 through a communications link to communications unit 310 and/or through a connection to input/output unit 312. The communications link and/or the connection may be physical or wireless in the illustrative examples. The computer readable media also may take the form of non-tangible media, such as communications links or wireless transmissions containing the program code.

In some illustrative embodiments, program code 316 may be downloaded over a network to persistent storage 308 from another device or data processing system for use within data processing system 300. For instance, program code stored in a computer readable storage medium in a server data processing system may be downloaded over a network from the server to data processing system 300. The data processing system providing program code 316 may be a server computer, a client computer, or some other device capable of storing and transmitting program code 316.

The different components illustrated for data processing system 300 are not meant to provide architectural limitations to the manner in which different embodiments may be implemented. The different illustrative embodiments may be implemented in a data processing system including components in addition to or in place of those illustrated for data processing system 300. Other components shown in FIG. 3 can be varied from the illustrative examples shown.

As one example, a storage device in data processing system 300 is any hardware apparatus that may store data. Memory 306, persistent storage 308 and computer readable media 318 are examples of storage devices in a tangible form.

In another example, a bus system may be used to implement communications fabric 302 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, without limitation, memory 306 or a cache such as that found in an interface and memory controller hub that may be present in communications fabric 302.

As mentioned above, the above described SAAS 100 incorporating computer 102 is operable for mitigating the risks associated with unabated sloshing of liquid within the hold of a ship. Particularly, and as described below, SAAS 100 operates to warn the ship operator, in real time, when dangerous levels of sloshing may be imminent or occurring. As described with respect to the following figures, SAAS 100 also displays alternative ship speeds and/or headings believed to be useful in reducing sloshing and thereby reducing the risk of damage to the ship and/or liquid cargo.

In one embodiment, SAAS 100 includes a personal computer that receives inputs from a ship motion sensor, for example, via a USB interconnection. In embodiments, the ship motion sensor is a unit that contains roll and pitch inclinometers, yaw rate gyros, and multi-axis accelerometers. In one specific embodiment, the motion sensor is placed proximate the centerline of the ship, with the fore-and-aft axis parallel to the center line.

In a real-time mode, the SAAS 100 continuously (i.e., at 4 Hz) monitors the vessel motion, computes the ship's roll and pitch periods, and plots them onto a strip chart (either on paper or on a computer display). The cargo tank natural periods (which are calculated for the user-specified fill level) are indicated on the same strip chart. When an amplitude and number of consecutive ship motion periods meet certain thresholds, the SAAS 100 indicates a sloshing warning or sloshing alarm (alert 142) visually and/or audibly.

When operated in a predictive mode, SAAS 100 indicates the possibility of tank sloshing in forecast or user-specified weather conditions. In the predictive mode, SAAS 100 utilizes an algorithm to predict vessel motion amplitudes and periods under various sea conditions, headings and speeds utilizing proven ship motion theory. Advice on heading and speed changes to mitigate the risk of structural damage due to sloshing are depicted, in one embodiment, through the use of a polar diagram indicating the relative risks of tank resonance with ship motions. In an embodiment, a user of the SAAS 100 can specify the thresholds (e.g., Safe Operating Limits) to tailor the SAAS 100 for the intended passage and cargo conditions. The Safe Operating Limits can also be used as routing constraints to optimize the route for minimum fuel consumption and on-time arrival.

Figure 5:
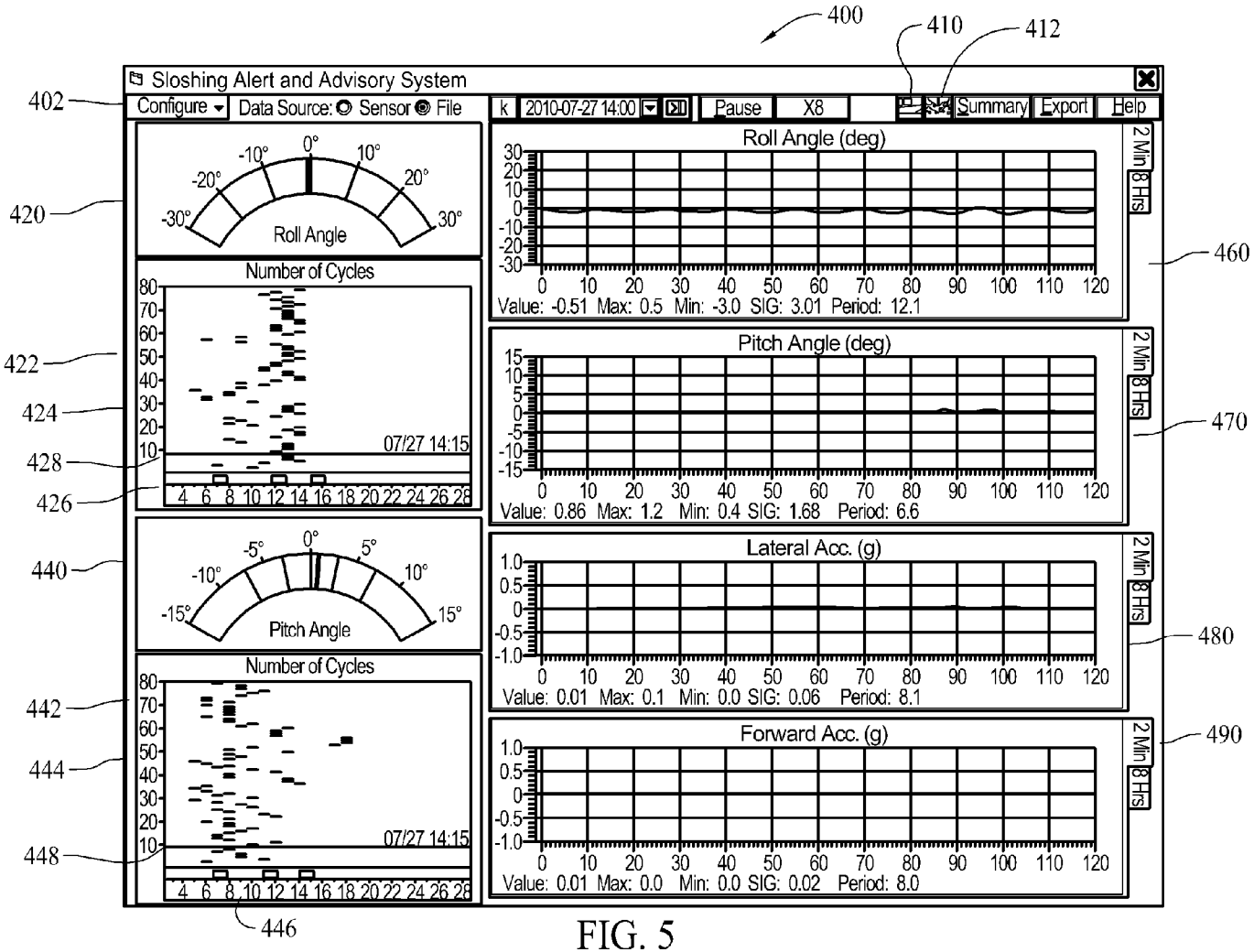
FIG. 5 is a depiction of a motion recorder display screen.

Starting the SAAS program within computer 102 results in a motion recorder display screen 400, such as shown in FIG. 5, being displayed on a user interface. In the illustrated embodiment, a top menu bar 402 of screen 400 contains Configure, Data Source, Sensor, File, and Help user selections. A ship icon 410 and a sea keeping icon 412 are further described below. A selection of Configure allows the user to configure the ship motion sensors 124 and displays. A selection of Data Source indicates whether the SAAS 100 is displaying the data from the ship motion sensors 124 or the stored data from past recordings stored in the storage 144 area.

Still referring to screen 400, on the top left is a real-time roll angle gauge 420 which provides the roll angle in degrees. Below the roll angle gauge 420 is a roll cycle indicator 422 that indicate the number of roll cycles 424 and their associated roll periods 426 that have been previously recorded. The time of recording can be referenced by a white horizontal line with Month/Date/Hour which is inserted into roll cycle indicator 422, for example, every fifteen minutes. Similarly, another set of displays are for the recorded pitch angle and associated periods. Specifically, a real-time pitch angle gauge 440 provides the pitch angle in degrees. Below the pitch angle gauge 440 is a pitch cycle indicator 442 that indicate the number of pitch cycles 444 and their associated pitch periods 446 that have been previously recorded. The time of recording can be referenced by a white horizontal line 448 with Month/Date/Hour which is inserted into pitch cycle indicator 442, for example, every fifteen minutes.

Figure 6:
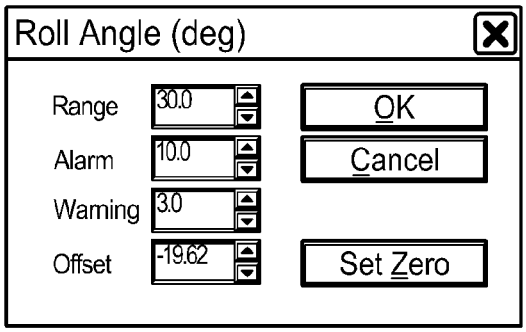
FIG. 6 is an example of a motion channel configuration screen.

The histogram (cumulative number of cycles) of the roll and pitch periods is updated when each motion cycle is completed. Each individual roll or pitch cycle is shown on the respective indicator 422, 442 as a line above its corresponding period, which ranges, for example, from 3 to 28 seconds. The colors of the lines (i.e., green, yellow, red) indicate the amplitude (maximum angle) of the motion and correspond to normal, warning, and alarm levels. The thresholds for each level are configurable by the user as shown in FIG. 6. In one embodiment, an alarm is set to activate when SAAS 100 counts more than a user-specified number of recent cycles near the resonance periods of the tanks, which is dependent on fill levels. For example, one default threshold is that six out of last ten cycles are within one second of the natural period of any of the tanks.

Figure 7:
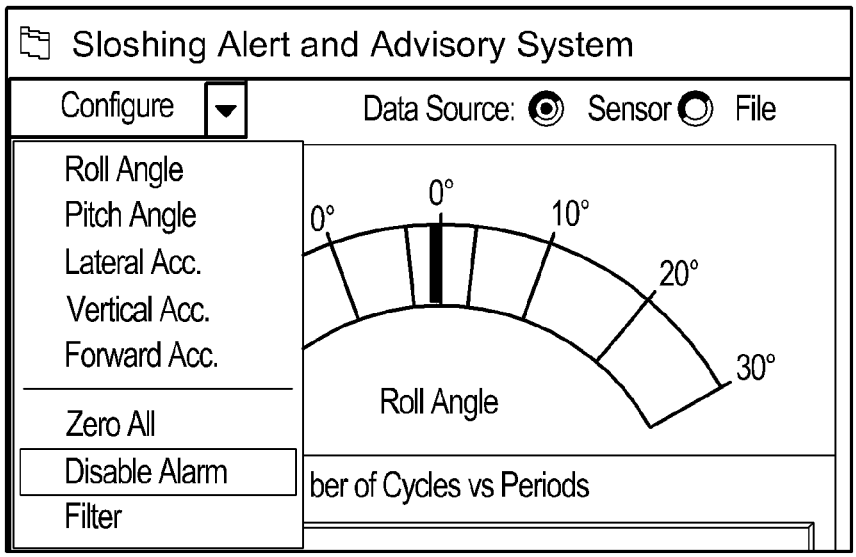
FIG. 7 depicts selection of a "Disable Alarm" selection from the screen of FIG. 5.

In one embodiment, an audible alarm may be disabled by selection of a "Disable Alarm" selection under the Configure menu as shown in FIG. 7 or, in the case of an SAAS embodiment running on a personal computer, by turning off the computer speaker as provided through an operating system of the personal computer.

Referring once again to FIG. 5, individual motion time histories for roll angle 460, pitch angle 470, lateral acceleration 480, and forward acceleration 490, for the past two minutes along with a maximum value, period and significant value for each are provided. Each motion time history includes an eight-hour tab which allows a user to switch the individual histories to the hourly maximum of the past eight hours. In one embodiment, the scales in the histories are color-coded from green to yellow to red, indicating safe, warning and alarm status range. As described, the first two history channels are for roll angle 460 and pitch angle 470, the other two channels are for accelerations. In embodiments with a three-axis acceleration measurement option, double clicking on an acceleration display will replace the current channel with the axis (such as upwards acceleration) that is not currently displayed.

Selection of the Configure button on display 400 causes SAAS 100 to display a drop down list of motion sensor channels to be configured as shown in FIG. 7. Selecting the desired sensor will allow the user to change the warning and alarm levels as well as setting the scales and offsets to calibrate/setup the sensor. An example of a motion channel configuration is shown in FIG. 6. A Zero All selection, as shown in FIG. 7, causes all the channels to have zero reading by automatically calculating the offset for each channel. After configuring each channel, the parameters are stored in a file, for example, a MOTION.INI file, so that SAAS 100 will use the same setup next time the program is run.

Figure 8:
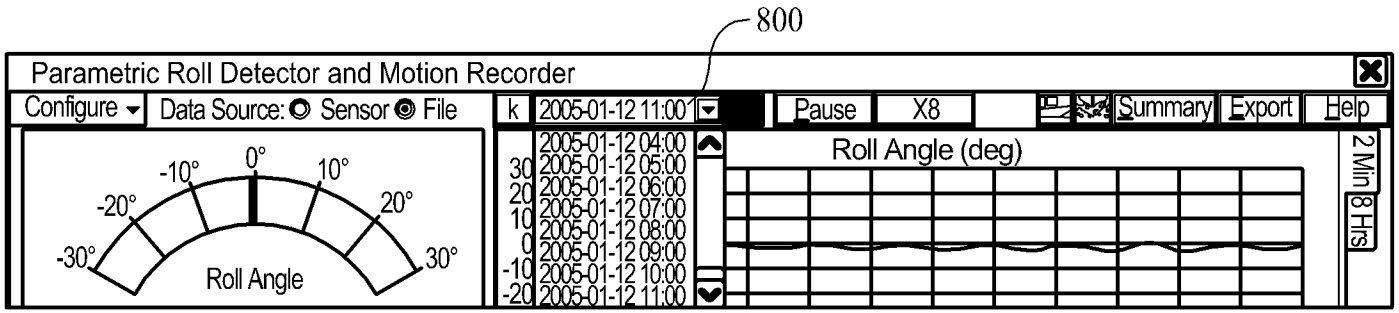
FIG. 8 is a depiction of a pull-down menu for selecting past files as recorded by the SAAS of FIG. 3.

Referring once again to FIG. 5, the SAAS 100 can be instructed to playback a recorded history of ship motion by simply changing the Data Source in the top menu bar 402 from "Sensor" to "File" through user selection, for example, by selecting the appropriate button. In the playback mode (when "File" is selected), the top menu bar 402 shows additional items that can be selected by a user, for example, a pull-down menu for selecting past files as well as Play, Pause, and Stop buttons as shown in FIG. 8.

The drop down list 800 allows the user to select a particular period to playback. In the illustrated embodiment, the time code format is YYYY-MM-DD HH:MM. Selection of the "X1" button causes the time histories to be displayed at the same speed as they were recorded in real-time. Clicking on the button again will double the current speed up to a maximum of X32 as the computer processor speed permits. Clicking on Play will start the replay. When playing, the button changes to a "Pause" button. Selection of Pause will stop the replay. As contemplated, the Playback function is to be used to investigate past events of sloshing and further refine the detection algorithms within SAAS 100.

Figure 9:
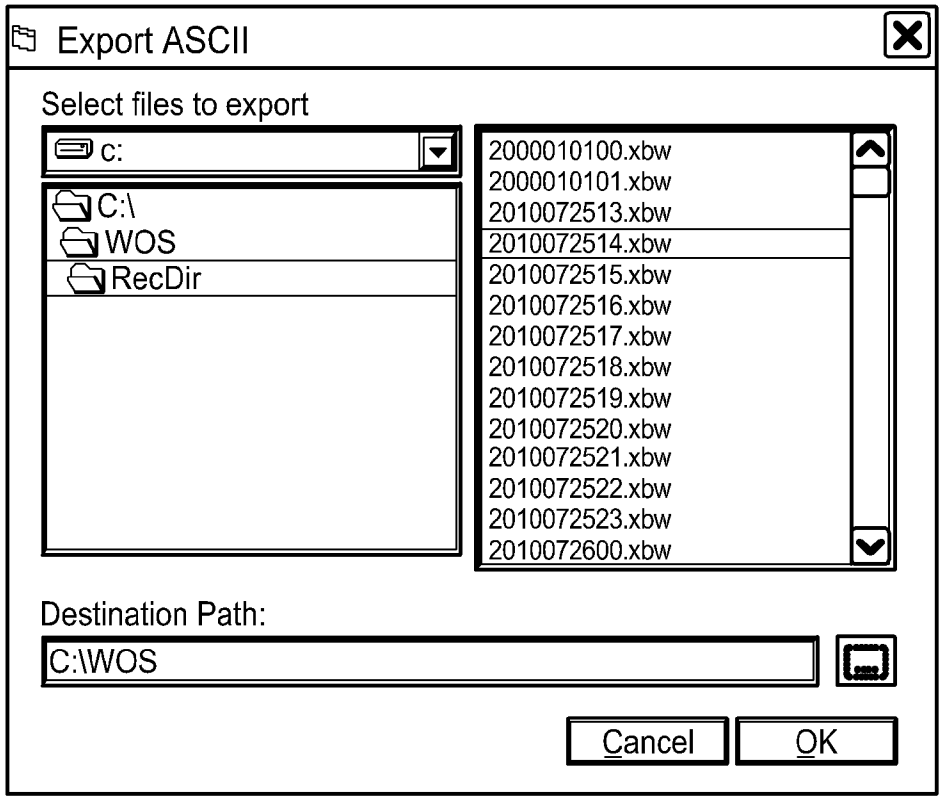
FIG. 9 depicts selection of SAAS files to export and save under user specified folders.

To further facilitate the investigation of past events and developing better algorithms to predict sloshing induced damage, SAAS 100 provides the capabilities to convert the binary records into comma delimited text files for export into spreadsheets by simply selecting the files with YYYYMMDDHH.xbw to export and save under user specified folders as shown in FIG. 9. Selection of the "Summary" button on the top menu bar 402 (shown in FIG. 5) creates a comma delimited file on hourly summary of recorded motions with reference to GPS location, ship speed and course (if recorded).

Figure 10:
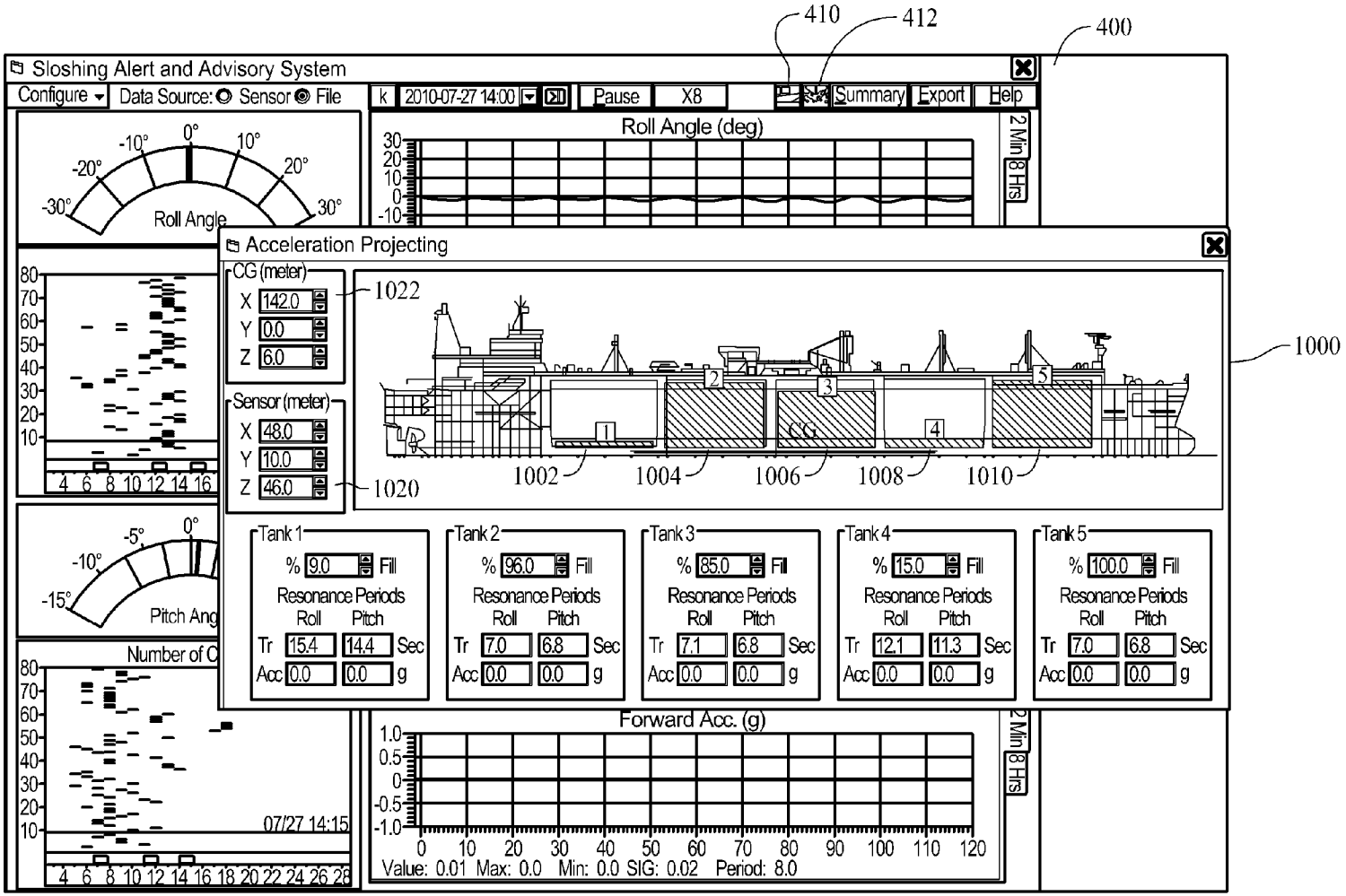
FIG. 10 is a liquid natural gas ship schematic display selected from the screen of FIG. 5.

FIG. 5 also includes a ship icon 410 on the top menu bar 402 user selection of which causes SAAS 100 to display a schematic 1000 of the LNG carrier as shown in FIG. 10. Referring to FIG. 10, the levels for the individual tanks, 1002, 1004, 1006, 1008, and 1010 are specified by the user or controlled by other shipboard sensors or instrumentation, for example, tank level sensors. For example, and through user input, changing the percentage that each cargo tank is filled will cause the estimated natural periods for roll and pitch, based on the tank dimensions and fill level, to be calculated and displayed. In one embodiment, the natural periods are calculated using linear wave theory algorithms stored in SAAS 100 (shown in FIG. 3 as 132). By accurately entering the locations 1020 of the motion sensor and the center of gravity (CG) 1022 of the ship, it is possible to estimate the maximum lateral and longitudinal accelerations at the fill level of each tank. The magnitude can also be used as another alarm trigger to indicate risk of damage due to tank sloshing in real time.

Figure 11:
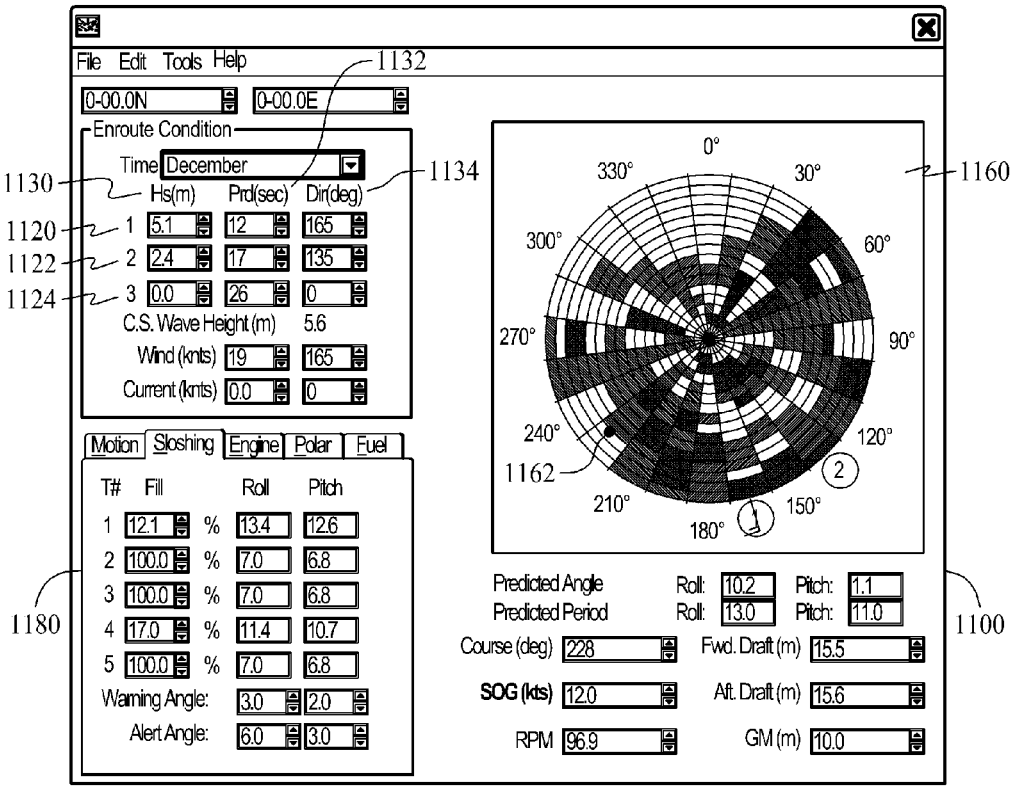
FIG. 11 is a polar diagram display selected from the screen of FIG. 5 illustrating headings and speeds likely to reduce sloshing of a load.

To assist the user in deciding the best ship speed and heading to mitigate the risk of damage due to heavy weather as well as sloshing, SAAS 100 provides the capability of predicting vessel motion and period based on established ship motion theory. Clicking on the Seakeep button 412 on the menu bar 402 will cause the polar diagram display 1100 of FIG. 11 to be displayed. Referring to polar diagram 1100, the top left panels contains information on ship's position and time taken from GPS. Based on the location and time, the SAAS 100 automatically extracts the forecast environmental conditions from a weather file downloaded from an external source. The wave forecast is depicted by three wave trains 1120, 1122, 1124 or sea and swells. The height 1130, period 1132, and direction 1134 can be manually changed by clicking on the arrows should the real observed conditions differ. The wave data are used in the ship motion calculations to predict roll, pitch angles, periods as well as other seakeeping events such as slamming and bow submergence. For sloshing warning, the predicted angle and period of roll and pitch are shown on the right panel below the polar diagram 1160.

The polar diagram 1160 shows the incoming wind and wave directions as well as possible warning at each ship speed for 360 degrees of heading. The black dot 1162 is indicative of the present ship speed and course over ground, for example, from GPS input. Each concentric circle is 1 knot. The lower left panel 1180 shows the estimated natural periods of the liquid for roll and pitch at user defined fill levels for each tank. When the natural periods are within 1 second of the ship's roll or pitch motion period, resonance may occur. This is indicated by the color coded arc within polar diagram 1160. To indicate the severity of sloshing resonance, user can set warning and alert levels based on the predicted roll and pitch angles as described above. When sloshing is predicted, the ship's roll or pitch periods and affected tank periods turns into Green (possible), Yellow (warning) and Red (alert) color. One objective of the polar chart 1160 display is to provide guidance on ship speed and heading changes which will minimize the risk of sloshing, generally, directing the ship from red arcs toward green arcs. In conjunction with the real-time display of the measured roll and pitch angle/period, overall risk of sloshing induced structural damage will be reduced. Summarizing, polar diagram 1160 in one embodiment passively displays all the possible headings and speeds one could use to minimize sloshing providing all the information needed for a captain to choose one heading and speed to reduce sloshing.

Figure 12:
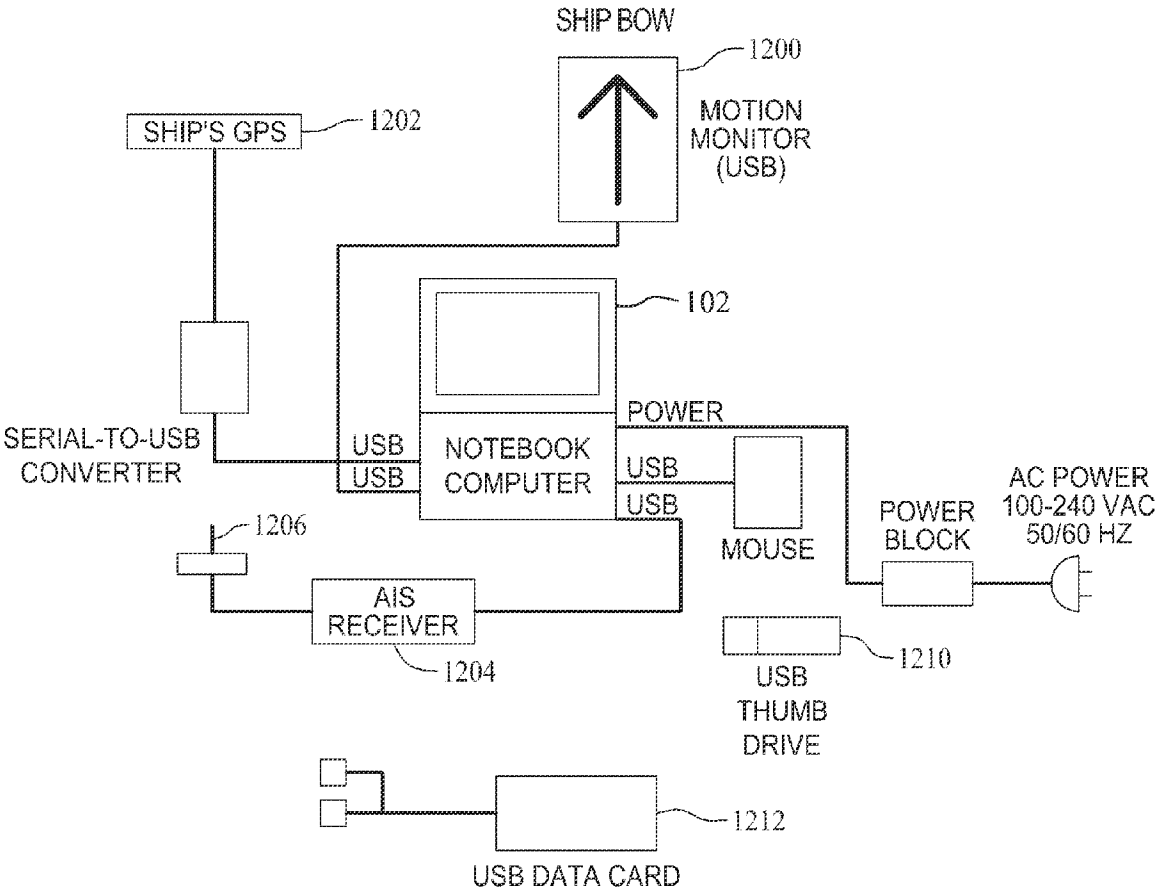
FIG. 12 is a block diagram of the sloshing alert and advisory system (SAAS) of FIG. 3.

FIG. 12 is a block diagram of one embodiment of SAAS 100 illustrating various components therein. As illustrated, computer 102 is communicatively coupled to a ship motion sensor 1200 which provides pitch, roll, and yaw data to computer 102. To provide location and heading data to computer 102, computer 102 is communicatively coupled to one or more of a GPS 1202, gyrocompass or satellite compass, or an automatic identification system (AIS) 1204 which incorporates an AIS antenna 1206. As shown in FIG. 12, the communicative coupling between the computer 102 and such peripherals is accomplished using USB connections; however, other communications protocols and interfaces may be used. To provide computer 102 with other data (such as seakeeping models, tank natural periods and the like as described above), as well as the storage capabilities described herein, computer 102 may interface to one or more of an external memory 1210, such as a thumb drive or to a data card 1212, to other shipboard instrumentation, or to the ship's network.

In one embodiment, GPS and gyrocompass signal from the ship's navigation system are used to get ship's position, heading, and speed. In another embodiment, this data is collected from a stray AIS signal that is available on certain ships. External memory 1210 is used in one embodiment to get the data off the ship. With the data card 1212, such data can be uploaded over an available cell phone network when the ship is in port. Not illustrated in FIG. 12, but another configuration allows for the uploading of such data using a satellite-based connection such as Iridium's OpenPort or Inmarsat's Fleet-Broadband.

Uploading of data is not required for the functioning of SAAS 100, but such uploading allows shoreside persons to monitor and analyze results, as well as providing valuable feedback so that the SAAS can be updated to give improved performance that is based on actual performance.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for providing an alert when the motion of a ship indicates a potential of sloshing damage from liquid cargo being transported by the ship, said method comprising:

calculating, with a processing device, a natural period for the liquid cargo held in a tank based on received user inputs relating to a configuration of the tank and a fill percentage of the tank;

receiving, at the processing device, data describing actual motion of the ship with respect to three orthogonal axes;

calculating, with the processing device, a plurality of periods in a time sequence defined by the actual motion of the ship;

determining, with the processing device, a proximity of the natural period of the liquid cargo held in the tank to the plurality of periods in the time sequence defined by the actual motion of the ship; and providing an alert to a user if at least a predetermined plurality of the plurality of periods in the time sequence are each within a threshold proximity of the natural period of the liquid cargo held in the tank.

2. The method according to claim 1 wherein providing an alert comprises providing at least one of a suggested change in heading, a suggested change in speed, a suggested change in draft and trim, and a suggested change in schedule for the ship to separate the plurality of periods in the time sequence defined by the actual motion of the ship from the natural period of the liquid cargo held in the tank to reduce slosh resonances of the liquid cargo.

3. The method according to claim 1 further comprising using data relating to at least one of a hull configuration of the ship and data relating to ship motion theory for the ship to determine at least one of a suggested change in heading, a suggested change in speed, a suggested change in draft and trim, and a suggested change in schedule for the ship.

4. The method according to claim 1 wherein providing an alert to a user comprises providing a polar chart display indicating relative risks of tank resonance with ship motion and possible headings toward which the ship can be steered, and speeds associated with such headings, such that operating the ship in such areas, at an appropriate speed, will reduce sloshing resonances in the liquid cargo.

5. The method according to claim 1 further comprising predicting, based on received motion data, speed data and heading data, resonant motions for the ship that indicate operating conditions conducive to excessive sloshing.

6. The method according to claim 1 further comprising updating a motion modeling algorithm based on data received from a ship motion sensor describing the actual motion of the ship.

7. The method according to claim 1 further comprising displaying at least one of angular displacement, angular velocity, angular acceleration, linear displacement, linear velocity, and linear acceleration of the ship over a time period.

8. A sloshing alert and advisory system for a ship operable to transport a liquid cargo, said system comprising:

a processing device;

a user interface communicatively coupled to said processing device;

memory communicatively coupled to said processing device, said memory comprising data defining a natural period of the liquid cargo held in a tank within the ship; and a ship motion sensor communicatively coupled to said processing device and operable to provide data describing a plurality of periods in a time sequence defined by the actual motion of the ship with respect to three orthogonal axes, said processing device programmed to determine a proximity of the natural period of the liquid cargo held in the tank within the ship to the plurality of periods in the time sequence defined by the actual motion of the ship, and to provide an alert via said user interface when at least a predetermined plurality of the plurality of periods in the time sequence are each within a threshold proximity of the natural period of the liquid cargo held in the tank within the ship indicative that actual ship motions are approaching conditions that potentially lead to excessive sloshing of the liquid cargo.

9. The sloshing alert and advisory system according to claim 8 wherein the liquid cargo is held in a plurality of tanks within the ship; and said data defining the natural period of the liquid cargo held in the tank within the ship comprises tank configuration data for each tank holding the liquid cargo within the ship and a fill level for each tank holding the liquid cargo within the ship.

10. The sloshing alert and advisory system according to claim 8 wherein said data describing the motion of the ship with respect to three orthogonal axes comprises data relating to hull configuration for the ship and data relating to ship motion theory associated with the ship.

11. The sloshing alert and advisory system according to claim 8 wherein said processing device is programmed to indicate, via said user interface, possible headings toward which the ship steers, and speeds associated with such headings, such that operating the ship in such areas, at an appropriate speed, reduces sloshing resonances in the liquid cargo.

12. The sloshing alert and advisory system according to claim 8 wherein said processing device is programmed to provide, via said user interface, at least one of a suggested change in heading, a suggested change in speed, a suggested change in draft and trim, and a suggested change in schedule for the ship to separate the plurality of periods in the time sequence defined by actual motion of the ship from the natural period of the liquid cargo held in the tank within the ship.

13. The sloshing alert and advisory system according to claim 8 wherein said memory comprises a motion modeling algorithm for the ship, said processing device programmed to update said motion modeling algorithm based on data received from said ship motion sensor.

14. The sloshing alert and advisory system according to claim 8 further comprising a position sensor communicatively coupled to said processing device and operable to provide data describing a position of the ship, said processing device programmed to cause said user interface to display a polar chart, referenced to a current position of the ship, the polar chart comprising at least one of a suggested heading, speed, route, draft and trim, and schedule that should result in a separation of the plurality of periods in the time sequence defined by actual motion of the ship from the natural period of the liquid cargo held in the tank within the ship.

15. The sloshing alert and advisory system according to claim 8 wherein said processor is programmed to store data indicative of actual motion of the ship in said memory over a time period.

16. The sloshing alert and advisory system according to claim 8 wherein said processor is programmed to cause said user interface to display at least one of angular displacement, angular velocity, angular acceleration, linear displacement, linear velocity, and linear acceleration of the ship over a time period.

17. The sloshing alert and advisory system according to claim 8 wherein said ship motion sensor comprises pitch inclinometers, roll inclinometers, yaw rate gyro, and axis accelerometers oriented in three orthogonal axes.

18. The sloshing alert and advisory system according to claim 8 wherein said processing device is programmed to receive an input regarding a fill level for each liquid cargo tank.

19. A non-transitory computer-readable medium for providing an alert when the motion of a ship indicates a potential of sloshing damage from liquid cargo being transported by the ship, wherein the non-transitory computer-readable medium includes computer-executable instructions embodied thereon, wherein when executed by at least one processor, the computer-executable instructions cause the at least one processor to:

determine, based on data related to the configuration of each of a plurality of tanks containing the liquid cargo and a fill percentage for each of the plurality of tanks, as input by at least one of a user and a sensor, a natural period of the liquid cargo within each of the plurality of tanks;

determine, a plurality of periods in a time sequence defined by the actual motion of the ship with respect to three orthogonal axes based on data received from a ship motion sensor;

determine a proximity of the natural period of the liquid cargo within each of the plurality of tanks to the plurality of periods in the time sequence defined by the actual motion of the ship; and provide an alert via a user interface communicatively coupled to the at least one processor when at least a predetermined plurality of the plurality of periods in the time sequence are each within a threshold proximity of the natural period of the liquid cargo within each of the plurality of tanks such that actual ship motions are approaching conditions that can lead to excessive sloshing of the liquid cargo.

20. The non-transitory computer-readable medium according to claim 19, wherein the computer-executable instructions further cause at least one processor to provide, via the user interface, at least one of a suggested change in heading, a suggested change in speed, a suggested change in draft and trim, and a suggested change in schedule for the ship to separate the plurality of periods in the time sequence defined by actual motion of the ship from the natural period of the liquid cargo within each of the plurality of tanks.

21. The non-transitory computer-readable medium according to claim 19, wherein the computer-executable instructions further cause at least one processor to provide, via the user interface, anticipated results from at least one of a change in heading, a change in speed, a change in draft and trim, and a change in schedule for the ship, the changes intended to separate the plurality of periods in the time sequence defined by actual motion of the ship from the natural period of the liquid cargo within each of the plurality of tanks.

22. The non-transitory computer-readable medium according to claim 19, wherein the computer-executable instructions further cause said at least one processor to update a motion modeling algorithm for the ship based on actual data received from a ship motion sensor.

* * * * *